US008185989B2

(12) United States Patent
Reece

(10) Patent No.: US 8,185,989 B2
(45) Date of Patent: May 29, 2012

(54) BRIDGE DEPLOYING APPARATUS AND BRIDGE TRANSPORTING VEHICLE INCORPORATING SUCH APPARATUS

(75) Inventor: Alan R. Reece, Wylam (GB)

(73) Assignee: Pearson Engineering Ltd., Newcastle upon Tyne (GB)

( * ) Notice: Subject to any disclaimer, the term of this patent is extended or adjusted under 35 U.S.C. 154(b) by 14 days.

(21) Appl. No.: 12/769,348

(22) Filed: Apr. 28, 2010

(65) Prior Publication Data

US 2010/0281633 A1 Nov. 11, 2010

(30) Foreign Application Priority Data

May 6, 2009 (GB) ..... 0907749.6
Jun. 30, 2009 (GB) ..... 0911206.1

(51) Int. Cl.
*E01D 15/12* (2006.01)
*E01D 15/10* (2006.01)

(52) U.S. Cl. ..... 14/2.5; 14/2.4

(58) Field of Classification Search ..... 14/2.4, 14/2.5

See application file for complete search history.

(56) References Cited

U.S. PATENT DOCUMENTS 3,305,885 A * 2/1967 Vaillant et al. ..... 14/2.4
3,492,683 A * 2/1970 Kinzel et al. ..... 14/2.5
4,510,637 A * 4/1985 Zlotnicki ..... 14/2.4
4,649,587 A * 3/1987 McFarlane et al. ..... 14/2.4
5,276,930 A * 1/1994 Parramore ..... 14/2.5
5,276,931 A * 1/1994 Karcher et al. ..... 14/2.5
5,937,468 A * 8/1999 Wiedeck et al. ..... 14/2.5
6,611,982 B2 * 9/2003 Eberl et al. ..... 14/2.5
7,174,591 B2 * 2/2007 Bertrand et al. ..... 14/2.5
7,568,252 B2 * 8/2009 Fraundorfer ..... 14/2.5
2009/0089943 A1 * 4/2009 Van Krimpen et al. ..... 14/2.4

* cited by examiner

*Primary Examiner* — Thomas Will
*Assistant Examiner* — Abigail A Risic
(74) *Attorney, Agent, or Firm* — Quarles & Brady LLP

(57) ABSTRACT

An apparatus for carrying a bridge on a vehicle and deploying the bridge to the ground is disclosed. The apparatus comprises a mounting bracket for mounting the apparatus to a vehicle, and a foot pivotable relative to the mounting bracket between a first position in which the foot engages the ground for supporting a bridge and a second position in which the foot is separated from the ground to permit movement of the vehicle. A bridge engaging probe is pivotable relative to the foot between a third position in which the bridge is on the ground and a fourth position in which the center of gravity of the bridge is raised relative to the third position. First and second cylinder actuators pivot the probe between the third and fourth positions. Third and fourth cylinder actuators pivot the foot between the first and second positions. The first and second cylinder actuators, and the third and fourth cylinder actuators, are arranged such that the sum of the turning moments produced by the first and second, and by the third and fourth actuators, is never zero when each pair of cylinder actuators pivots between said positions.

13 Claims, 14 Drawing Sheets

BRIDGE DEPLOYING APPARATUS AND BRIDGE TRANSPORTING VEHICLE INCORPORATING SUCH APPARATUS

FIELD OF THE INVENTION

The present invention relates to load handling apparatus and in particular to apparatus for loading and unloading portable bridge structures on to and off wheeled or tracked vehicles.

BACKGROUND OF THE INVENTION

In many field operations there is a requirement for tracked and/or wheeled vehicles to traverse terrain which contains obstacles such as waterways, ditches or other similar topographical features which cannot be crossed by the said vehicles. The conventional method of negotiating such terrain is to span the said obstacles by means of a bridge structure which is brought up to the obstacle by a vehicle. The vehicle bringing the portable bridge must be provided with suitable apparatus to position the bridge to span the obstacle and the said apparatus must have the capability of recovering the bridge and transporting it to another site when required.

Known methods for accomplishing the bridging operation fall into two broad categories. FIG. 1 shows the first type where the portable bridge 1 is carried on the vehicle 2 (a tracked vehicle is shown by way of example) with the bridge in the same configuration it would take up when spanning the obstacle (i.e. "right way up"). In order to position the bridge over the obstacle, the load handling mechanism must translate the bridge horizontally and then lower it to the ground. To recover the bridge the reverse process takes place. Prior art of this type accomplishes the loading and unloading process by two translations, one horizontal and the other vertical.

FIG. 2 shows the second type where the portable bridge 1 is mounted on the vehicle 2 the "wrong way up". The bridge has to be rotated through 180° and lowered down to ground level to span the obstacle. To recover the bridge the reverse of this process takes place. Prior art of this type accomplishes the loading and unloading process by a combination of a translation and a 180° rotation.

In prior art of the first type, translation is accomplished by a complicated rack-and-pinion mechanism driven by hydraulic motors, and the lowering by means of a system of levers. In prior art of the second type, both the rotation and translation processes are accomplished by a linkage system involving at least one pivotable structural element which is rotated by one or more hydraulic cylinders.

Bridges of this type have got longer as structural materials have improved. FIG. 3 shows a system capable of deploying a very long bridge. The bridge 1 must be located in a position such that when on top of the vehicle 2, the combined centre of gravity of the bridge and the deployment apparatus is over the centre of the wheelbase of the vehicle 2. This means that when the vehicle 2 is travelling without a bridge, the centre of gravity of the deployment apparatus is very far forward of that of the vehicle 2; this leads to unfavourable handling characteristics when the vehicle is in motion.

In FIG. 3, the vehicle 2 carries a bridge 1 in a stowed position. The bridge 1 is supported by the deploying apparatus which comprises of a ground engaging member (hereafter referred to as a foot) 3 a raising and lowering member 4, a bridge engaging member (hereafter referred to as a probe) 5 and three linear actuators 6, 7 and 8.

There are three stages to the deployment process:

First the bridge 1, the foot 3, the raising and lowering member 4, the probe 5 and the linear actuators 7 and 8 are rotated about axis 9 by the linear actuator 6 until the foot 3 presses on the ground as shown in FIG. 4.

Secondly the foot 3, the probe 5 and the linear actuator 8 are rotated about axis 10 until the foot 3 is flat on the ground (as shown in FIG. 5); this rotation being controlled by actuator 7.

Finally, the bridge 1 and the probe 5 are rotated about axis 11 until the bridge is in its deployed position (as shown in FIG. 6); this rotation being controlled by actuator 8.

The vehicle usually picks up the bridge after crossing it. The vehicle advances towards the bridge with the foot 3 just off the ground and the probe 5 lowered. Once the probe 5 has engaged with the socket on the bridge 1, it may be recovered using the reverse of the deployment process.

This prior art has the following disadvantages:

1) The three stage deployment process is complicated and heavy
2) It cannot be stowed on in a different position when it is not carrying a bridge—it remains a large structure projecting out in front of the vehicle, rendering it unfit for any other task.
3) It is connected to widely spaced pivots requiring that the roof of the vehicle be flat and low. Some of the pivots may be on the roof of the vehicle.
4) The linear actuator 8 has a very small moment arm when holding the bridge just off the roof of the vehicle, only about half of that when the bridge is fully deployed, while the moment of the bridge about the pivot 11 is the same in both cases. An excessively heavy, large bore cylinder is required, making the bridge recovery slow for a given hydraulic power.

Preferred embodiments of the present invention seek to overcome all of the disadvantages of the prior art.

SUMMARY OF THE INVENTION

According to an aspect of the present invention, there is provided an apparatus for carrying a bridge on a vehicle and deploying the bridge to the ground, the apparatus comprising:

mounting means for mounting the apparatus to a vehicle;

ground engaging means pivotable relative to said mounting means between a first position in which the ground engaging means engages the ground for supporting a bridge and a second position in which the ground engaging means is separated from the ground to permit movement of the vehicle;

first actuator means for pivoting the ground engaging means between said first and second positions;

bridge engaging means pivotable relative to said ground engaging means between a third position in which the bridge is on the ground and a fourth position in which the centre of gravity of the bridge is raised relative to the third position; and second actuator means for pivoting the bridge engaging means between said third and fourth positions;

wherein said first and/or said second actuator means comprises at least two respective actuators arranged such that the sum of the turning moments produced by said respective actuators is never zero when said actuator means pivots between said positions.

The present invention uses one or more instances of an unusual mechanism which rotates an arm about a pivot against the gravitational force due to the weight of said arm. FIG. 7 compares such an unusual mechanism with a conventional arrangement. The conventional long cylinder 13 drives the arm 12 providing a moment F*b about the axis 15. F*b is at a maximum when the arm is nearly vertical and the load moment W*a nearly zero. As the graph shows, the result is a mismatch which means that only about 90° of rotation can be obtained, and that very inefficiently because the average load is small compared to that available from the linear actuator.

In contrast, the upright cylinder 14 provides a moment F*c which has a characteristic matching that of the load moment W*a. A hiatus occurs when the arm 12 and cylinder 14 are upright as the cylinder can exert no moment. This is overcome by using two smaller bore cylinder with pivots offset (at A and B) as shown. This arrangement can efficiently drive an arm through more than 180°. The optimum positioning of these two pivots is a major part of designing a bridge deploying apparatus of this kind.

The apparatus may further comprise a foot frame pivotable in use about an axis on the vehicle and transverse to the direction of travel of the vehicle and adapted to transfer the ground engaging means between the ground and a location substantially at the height of the roof of the vehicle.

The bridge engaging means may comprise a bridge engaging probe pivotably mounted on a transverse axis across the ground engaging means and adapted to lay the bridge on the ground when the ground engaging means is in the first position and above the vehicle when the ground engaging means is in the second position.

The second actuator means may be connected between the bridge engaging means and the ground engaging means and said first actuator means may be connected between the ground engaging means and the vehicle in use.

Pivots on the ground engaging means mounted to a plurality of said actuators of said second actuator means and/or pivots on the vehicle in use mounted to the actuators of said first actuator means may be angularly offset relative to each other in planes transverse to the respective pivot axis.

The apparatus may further comprise at least one roller adapted to be fixed on the vehicle roof for supporting the bridge when in contact therewith.

In the absence of a bridge, the bridge engaging means and ground engaging means in use can be positioned in different positions from said respective fourth and second positions.

This provides the advantage of enabling weight distribution to be optimised.

At least one said linear actuator may be a hydraulic cylinder.

The apparatus may further comprise means for changing the direction of flow of hydraulic fluid into or out of at least one said hydraulic cylinder at appropriate angular positions of support frames connected thereto so that the direction of movement and continuity of rotation of the said support frames proceed in the desired direction.

The apparatus may further comprise means for closing off the ports to the hydraulic cylinders so as to selectively lock the rotary mechanism in specified configurations or to allow free flow of hydraulic fluid in to or out of the actuators so that the chosen frame can rotate freely.

According to another aspect of the present invention, there is provided a vehicle comprising a vehicle body and an apparatus as defined above.

The apparatus may be adapted to be releasably mounted to the vehicle body.

The apparatus may be adapted to be releasably mounted to the vehicle body by means of interlocking parts on the apparatus and the vehicle body and at least one locking mechanism on the apparatus and the vehicle body such that said interlocking parts and the or each said locking mechanism can be released in use by releasing the or each said locking mechanism.

BRIEF DESCRIPTION OF THE DRAWINGS

A preferred embodiment of the invention will now be described, by way of example only and not in any limitative sense, with reference to the accompanying drawings, in which.

DETAILED DESCRIPTION OF THE INVENTION

Figure 8:
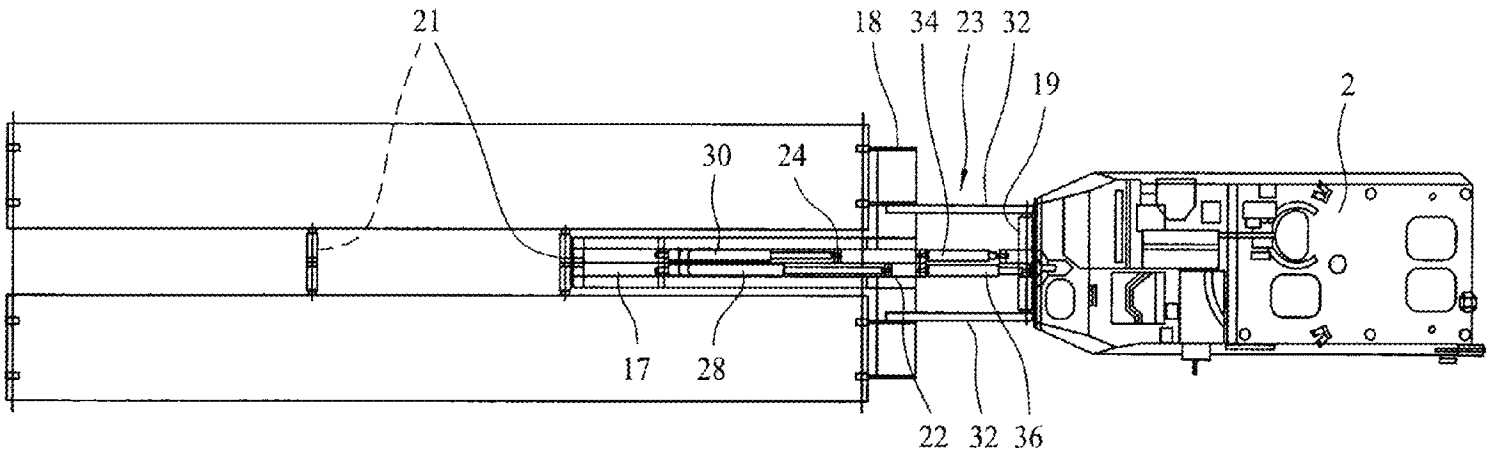
FIG. 8 is a plan view of a bridge transporting vehicle embodying the present invention and engaging a bridge in a deployed position thereof prior to lifting the bridge to a transport position thereof.
Figure 9:
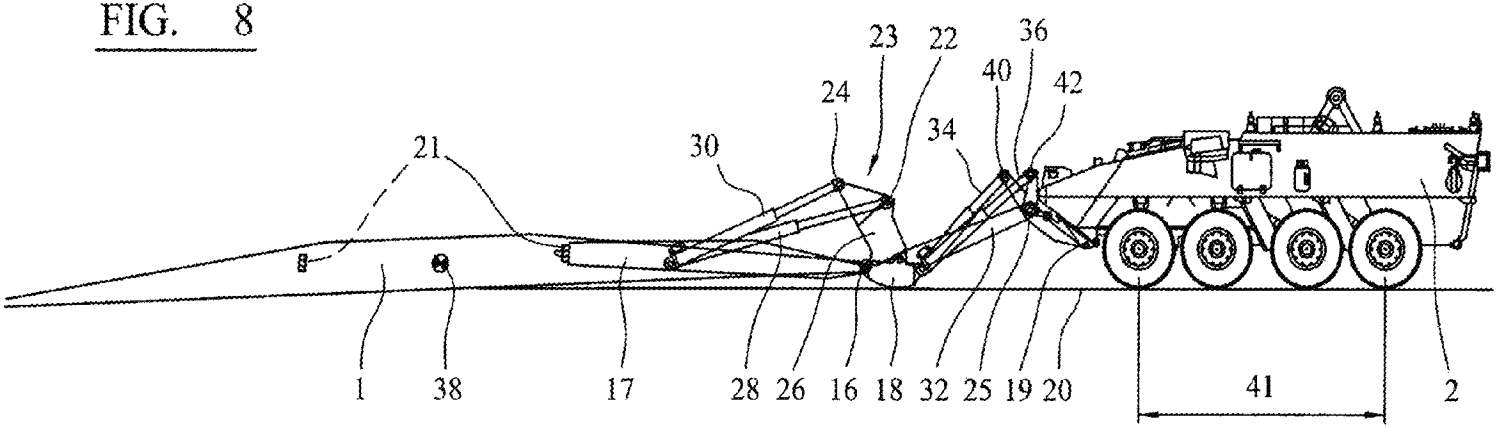
FIG. 9 is a side elevation view of the vehicle and bridge of FIG. 8.

Referring to FIGS. 8 and 9, a vehicle 2 has a bridge deploying apparatus 23 attached via a suitable mounting bracket 19 for the purposes of transporting and deploying a bridge 1.

The bridge deploying apparatus 23 comprises a probe 17 for insertion into an aperture 21 in the bridge 1, the probe 17 being pivotably mounted at a pivot 16 to a foot 18 which engages the ground 20. The probe 17 is also connected to separate locations 22, 24 on a bracket 26 extending from the foot 18 by means of a first hydraulic cylinder actuator 28 and a second hydraulic cylinder actuator 30. The foot 18 is connected to the mounting bracket 19 by means of a pair of support struts 32 which pivot about the axis 25, driven by a third cylinder actuator 34 and a fourth cylinder actuator 36.

Figure 11:
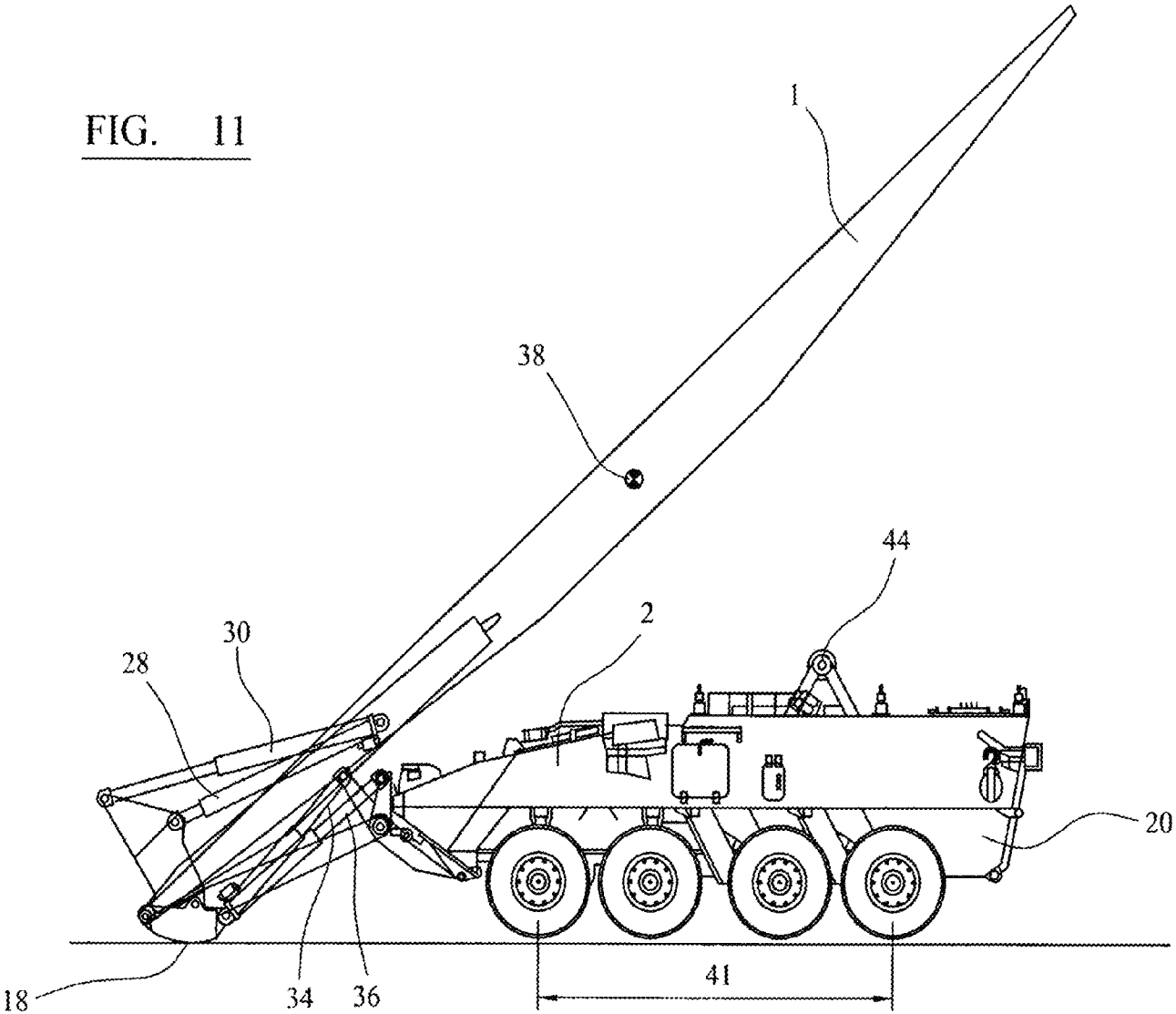
FIG. 11 is a side elevation view of the vehicle and bridge at a second stage of the movement of the bridge from the deployed to the transport position thereof.

The first 28 and second 30 cylinder actuators are arranged such that their extension and/or contraction causes pivoting movement of the probe 17 relative to the foot 18 from a first position as shown in FIG. 9, in which the bridge 1 is in a deployed position, to a second position as shown in FIG. 11, in which the foot 18 still rests on the ground 20 and the centre of gravity 38 of the bridge 1 is located well within the wheelbase 41 of the vehicle 2. This requires different phases in the extension and contraction cycle of the first cylinder actuator 28 from the phase of the corresponding extension/contraction cycle of the second cylinder actuator 30. This provides the advantage of enabling the large forces to be generated when required to move the bridge 1 and also achieving the large angular movement from the position shown in FIG. 9 to the position shown in FIG. 11, as a result of which the cylinder actuators 28, 30 can be made more compact and lighter than is the case with known bridge deploying apparatuses. In addition, the cylinder bores can be reduced, as a result of which faster deployment and retrieval of the bridge 1 can be achieved for a given hydraulic power.

Figure 13:
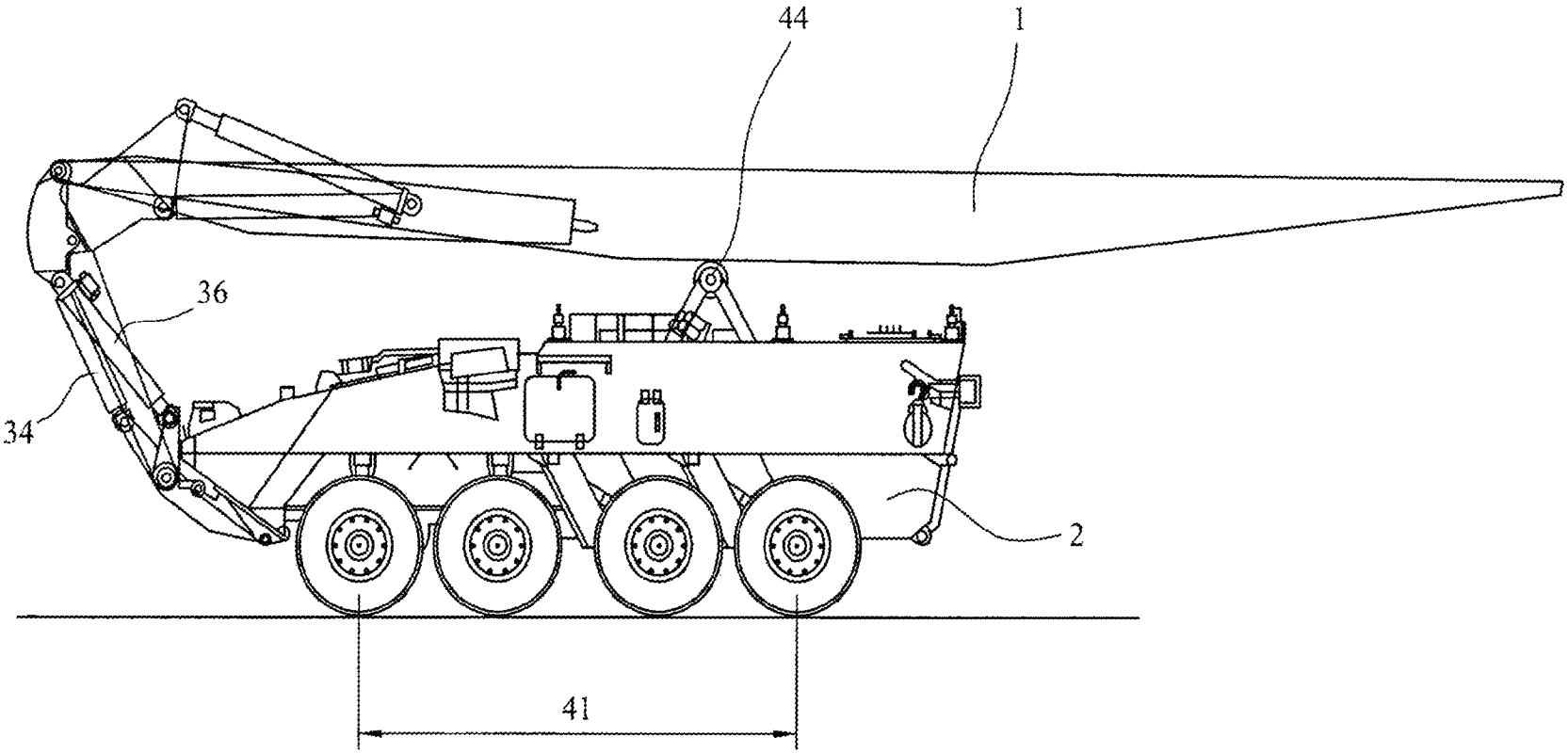
FIG. 13 is a side elevation view of the vehicle and bridge with the bridge in the transport position thereof.

Similarly, the third 34 and fourth 36 cylinder actuators are connected to respective separate locations 40, 42 on the vehicle mounting bracket 19, as a result of which the angular movement of the foot 18 relative to the vehicle 2 from the position shown in FIG. 11 to that shown in FIG. 13 is caused by different phases of the extension/contraction cycles of the third 34 and fourth 36 cylinder actuators. Furthermore, the deployment apparatus may be stowed as shown in FIG. 14 when the bridge 1 is not present which has the advantage of keeping the centre of gravity of the apparatus well within the wheelbase 41 of the vehicle 2.

Figure 14:
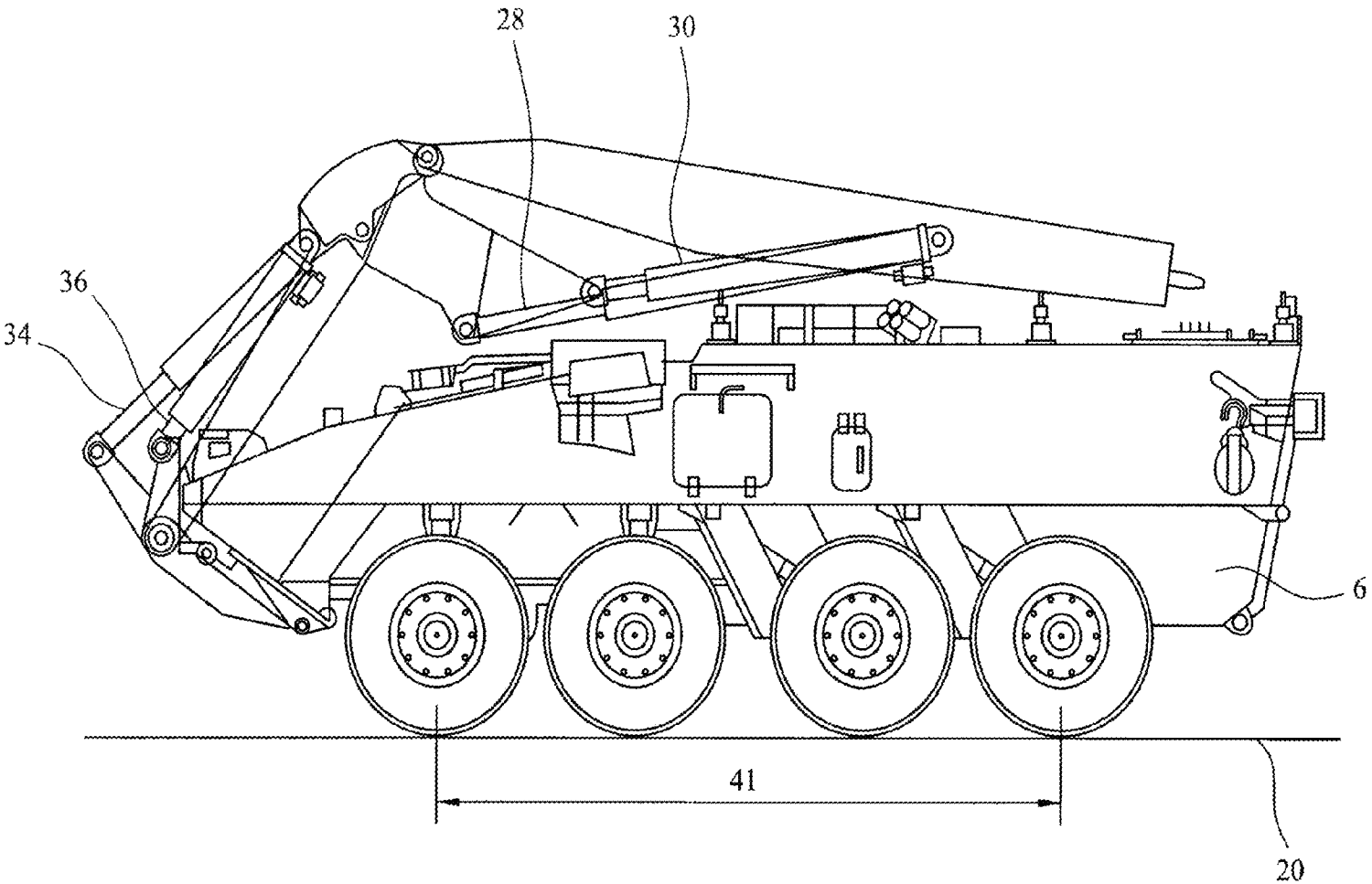
FIG. 14 is a side elevation view of the vehicle showing the deployment apparatus in the transport position used when no bridge is present.

This arrangement of the cylinder actuators 34, 36 provides the advantage of enabling the large forces to be generated when required to move the foot 18 from the position shown in FIG. 11 to that shown in FIG. 13 and also the achieves the large angular motion required to move the foot 18 from the position shown in FIG. 11 to that shown in FIG. 14, as a result of which the cylinder actuators 34, 36 can be made more compact and lighter than is the case with known bridge deploying apparatuses. In addition, the cylinder bores can be reduced, as a result of which faster deployment and retrieval of the bridge 1 can be achieved for a given hydraulic power.

The operation of the bridge transporting vehicle 2 and bridge deploying apparatus 23 thereof will now be described.

Referring to FIGS. 8 and 9, in order to retrieve the bridge 4 from a deployed position thereof for transport on the vehicle 2, the vehicle 2 is arranged as shown in FIG. 9 with the foot 18 of the bridge deploying apparatus 23 in engagement with the ground 20 and the probe 17 extending forwardly from the foot 18. The probe 17 is then caused to engage the corresponding aperture 21 in the bridge 1 by driving the vehicle 2 forwards to insert the probe 17 into the aperture 21.

Figure 10:
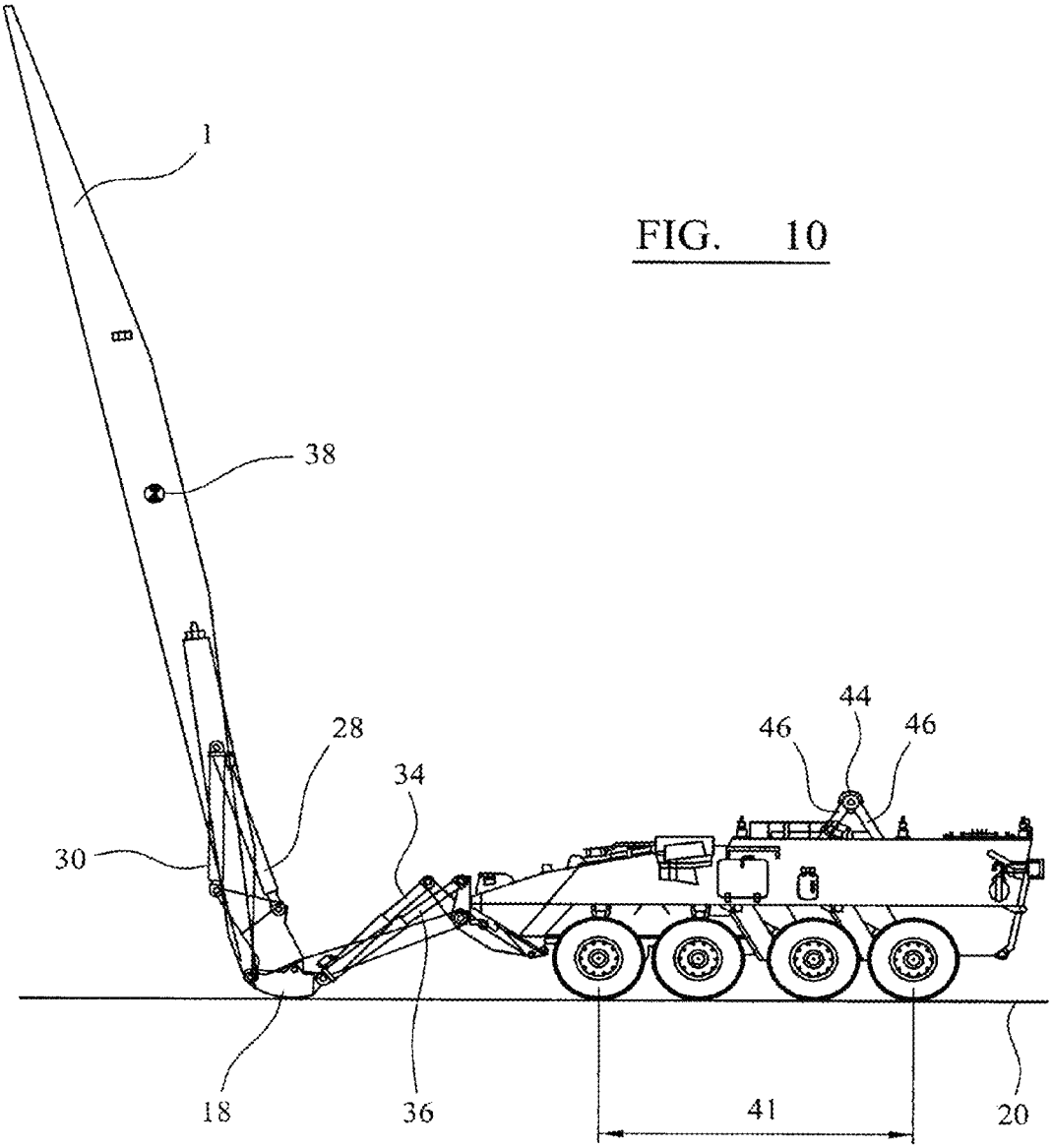
FIG. 10 is a side elevation view, corresponding to FIG. 8, of the vehicle and bridge at a first stage during movement of the bridge from the deployed to the transport position thereof.

The first 28 and second 30 cylinder actuators are then contracted to pivot the bridge 1 upwardly relative to the foot 18 to a transition position when the second cylinder actuator 30 has no moment about the bridge pivot 16, while the foot 18 rests on the ground 20. The bridge 1 is then further pivoted in a clockwise direction by further contracting the first cylinder actuator 28 and extending the second cylinder actuator 30 up to a second transition point when the first cylinder actuator 28 has no moment about the bridge pivot 16. FIG. 10 shows the apparatus 23 in a position between the first and second transition points.

The bridge 1 is then further pivoted in a clockwise direction by extending both the first 28 and second 30 cylinder actuators up to a point so that the centre of gravity 38 of the bridge 1 is located well within the wheelbase 41 of the vehicle, as shown in FIG. 11. At this point the cylinder actuators 28, 30 are locked.

Figure 12:
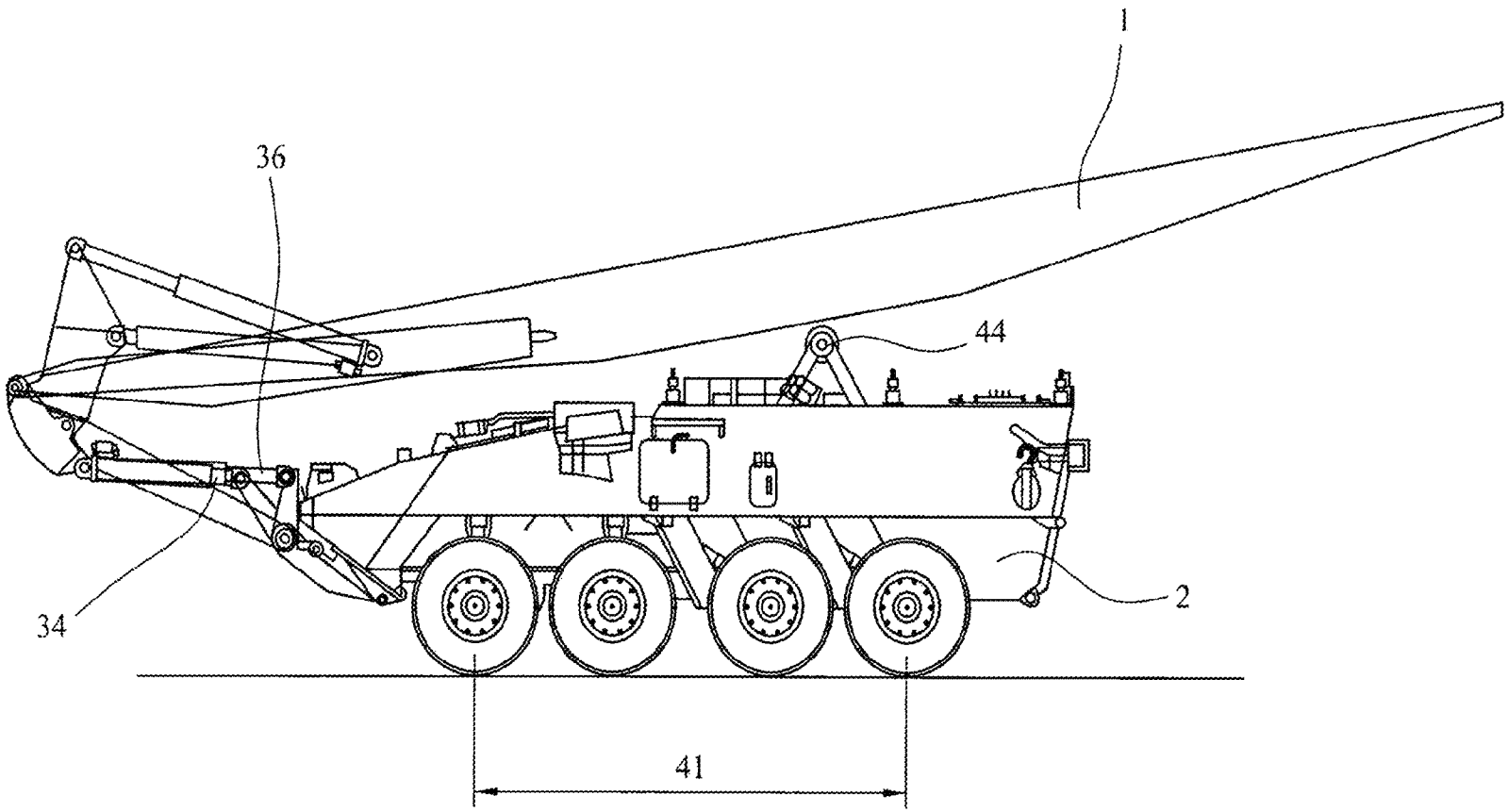
FIG. 12 is a view of the vehicle and bridge at a third stage of movement of the bridge from the deployed to the transport position.

The third 34 and fourth 36 cylinder actuators are then contracted to rotate the foot 18 clockwise about pivot 25. This causes the bridge 1 to further rotate clockwise relative to the vehicle 2 until the bridge 1 is in contact with the rollers 44 as shown in FIG. 12. At this point, the hydraulic control system is configured to allow free flow to the first 28 and second 30 cylinder actuators. The foot 18 is then further pivoted by contracting the third 34 and fourth 36 cylinder actuators up to the point shown in FIG. 13—during this last rotation, the free flow to the first 28 and second 30 cylinder actuators allows the bridge 1 and probe 17 to pivot freely relative to the foot 18. Thus the rollers 44 support a substantial portion of the gravitational load of the bridge 1 which minimises the forces that the cylinder actuators 28, 30, 34 and 36 are required to sustain. At the position shown in FIG. 13, the combined centre of gravity (not shown) of the bridge 1 vehicle 2 and deploying apparatus 23 is located well within the wheelbase 41 of the vehicle 2, which minimises the loading of the front axle of the vehicle 2 caused by the additional weight of the bridge deployment apparatus 23 which is mostly supported by the front axle of the vehicle 2.

In order to move the bridge 1 from the transport position shown in FIG. 13 to the deployed position shown in FIGS. 8 and 9, the above series of steps is reversed.

It will be appreciated by persons skilled in the art that during certain phases of the rotation of the bridge 1 about the axis 16, the cylinder actuators 28, 30 are lifting the bridge 1 and at others are controlling the speed at which the bridge 1 falls under the action of gravity. For this reason, it would be possible to control the rotation of the bridge 1 using pressure in only the annular side the cylinder actuators 28, 30 or by using tension-only actuators (such as a cable and winch). The same statement can be made regarding the cylinder actuators 34, 36 as they control the rotation of the foot 18 about axis 25.

Figure 1:
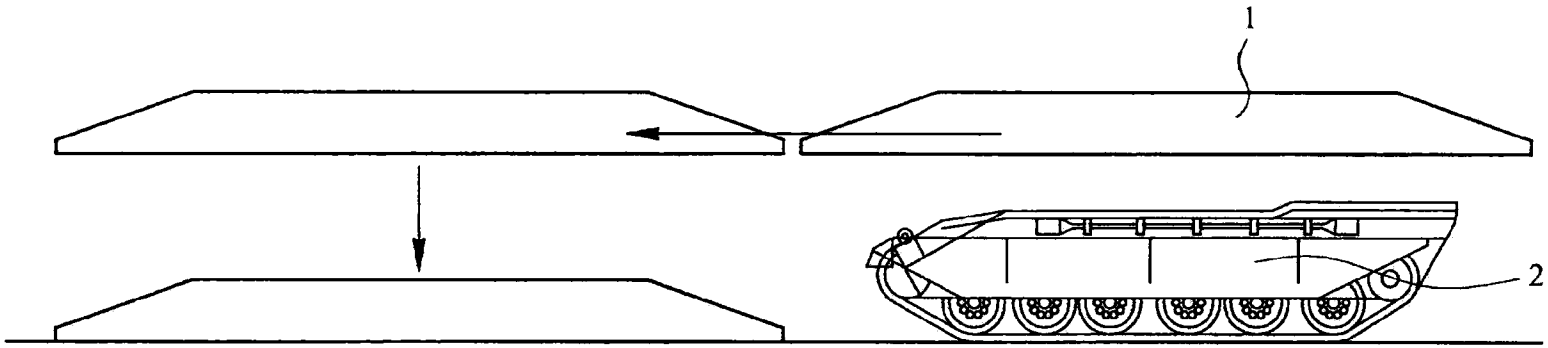
FIG. 1 PRIOR ART
FIG. 1 and FIG. 2 show the two main prior art bridge deployment methods.
Figure 2:
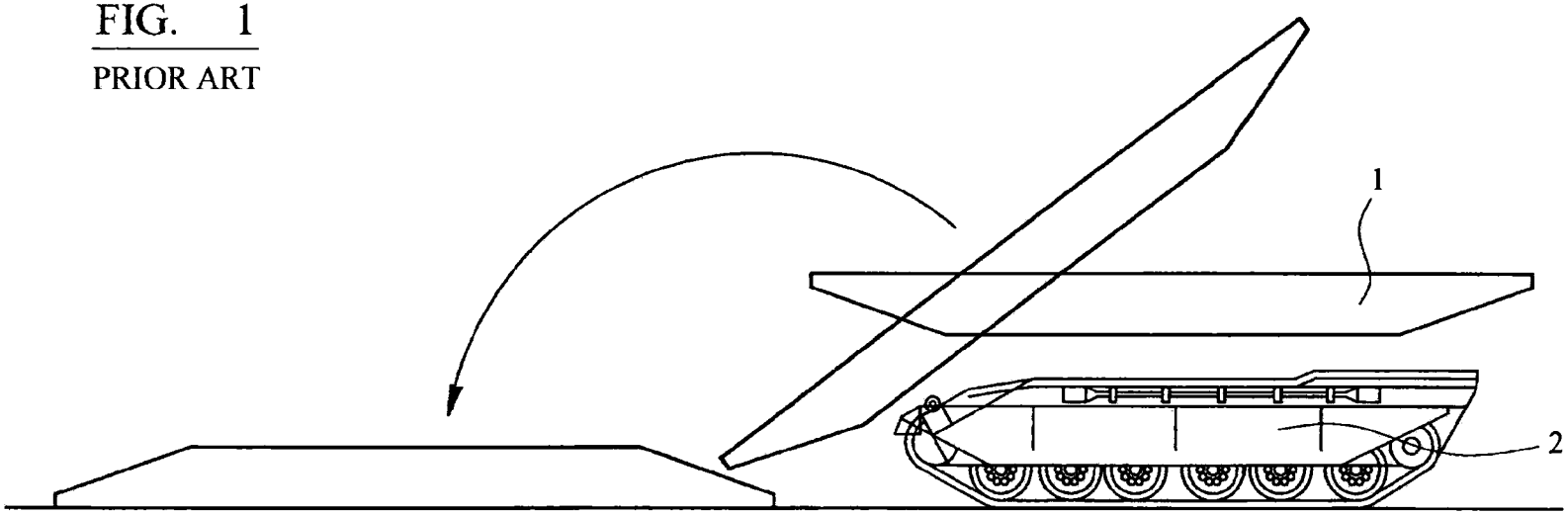
FIG. 2 PRIOR ART
Figure 3:
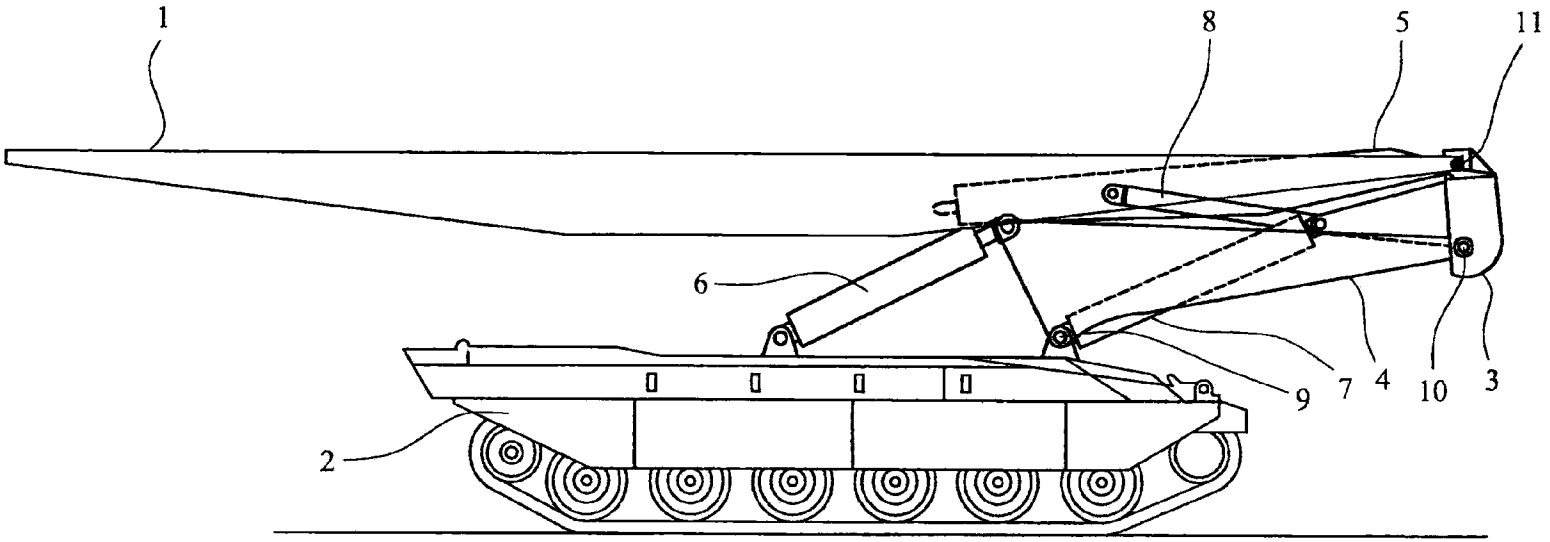
FIG. 3 PRIOR ART
FIG. 3 is a side elevation of the principal example of prior art, showing a bridge in the transport position.
Figure 4:
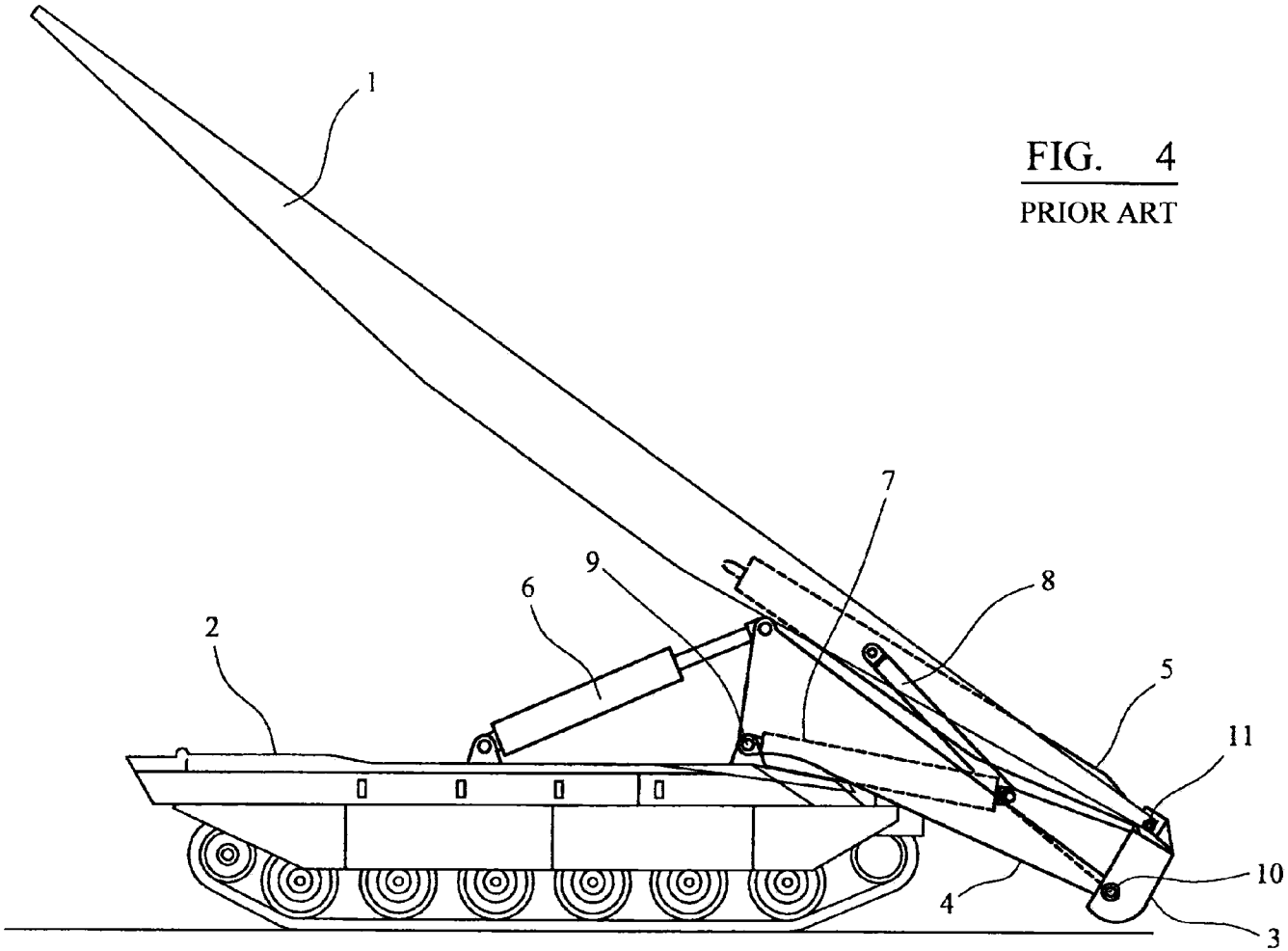
FIG. 4 PRIOR ART
FIG. 4 is a side elevation of the prior art launch mechanism at the end of the first stage of deployment.
Figure 5:
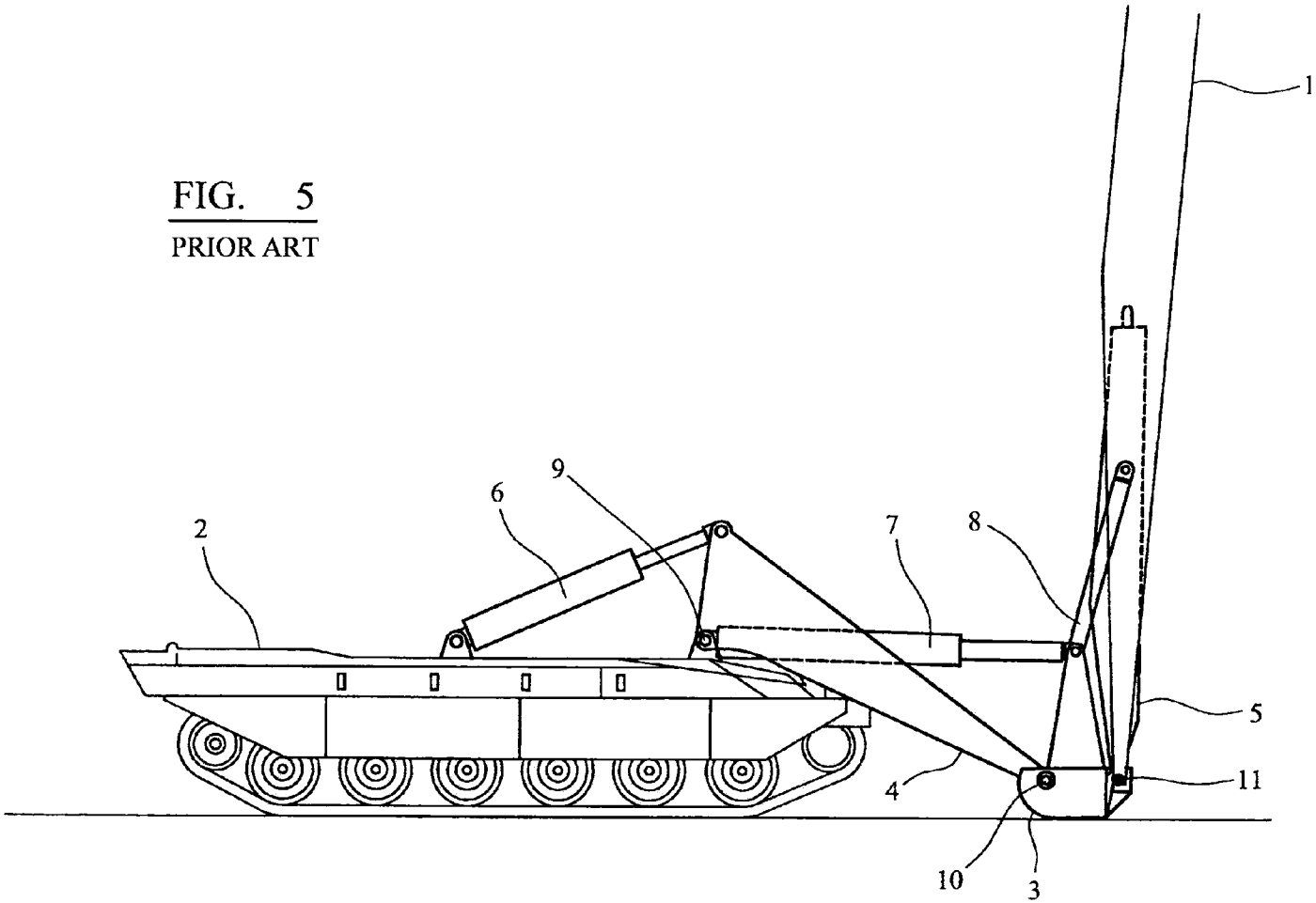
FIG. 5 PRIOR ART
FIG. 5 is a side elevation of the prior art at the end of the second stage of deployment.
Figure 6:
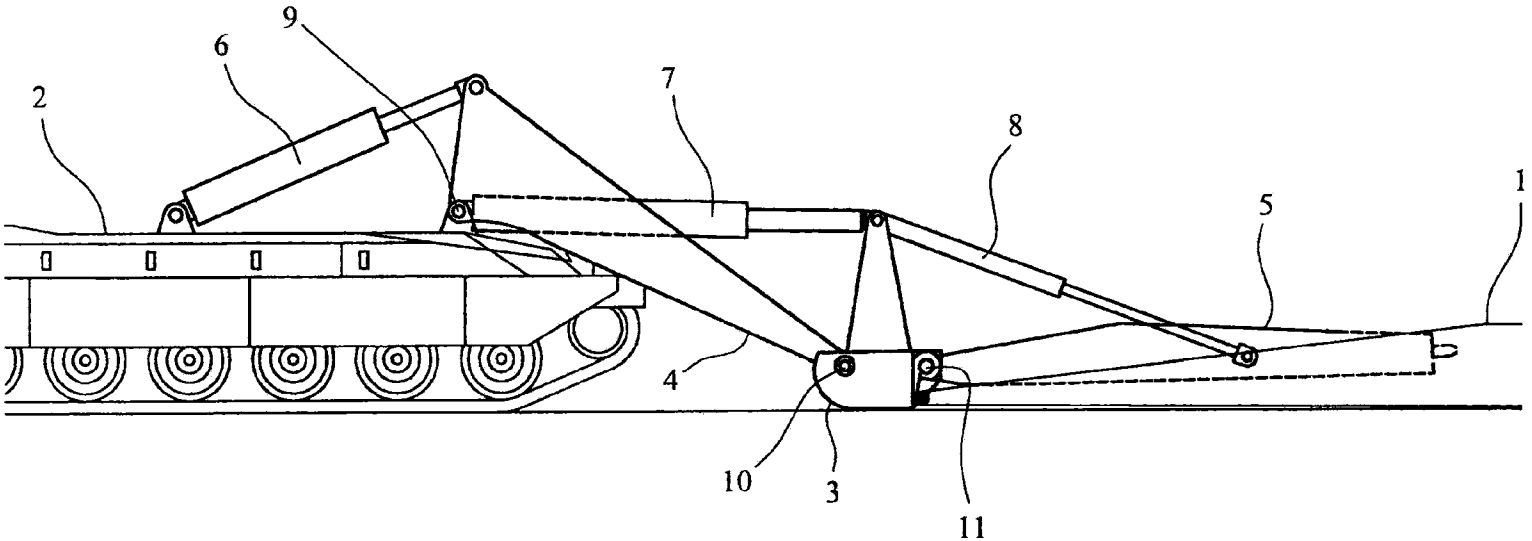
FIG. 6 PRIOR ART
FIG. 6 is a side elevation of the prior art at the end of the third and final stage of the deployment process.
Figure 7:
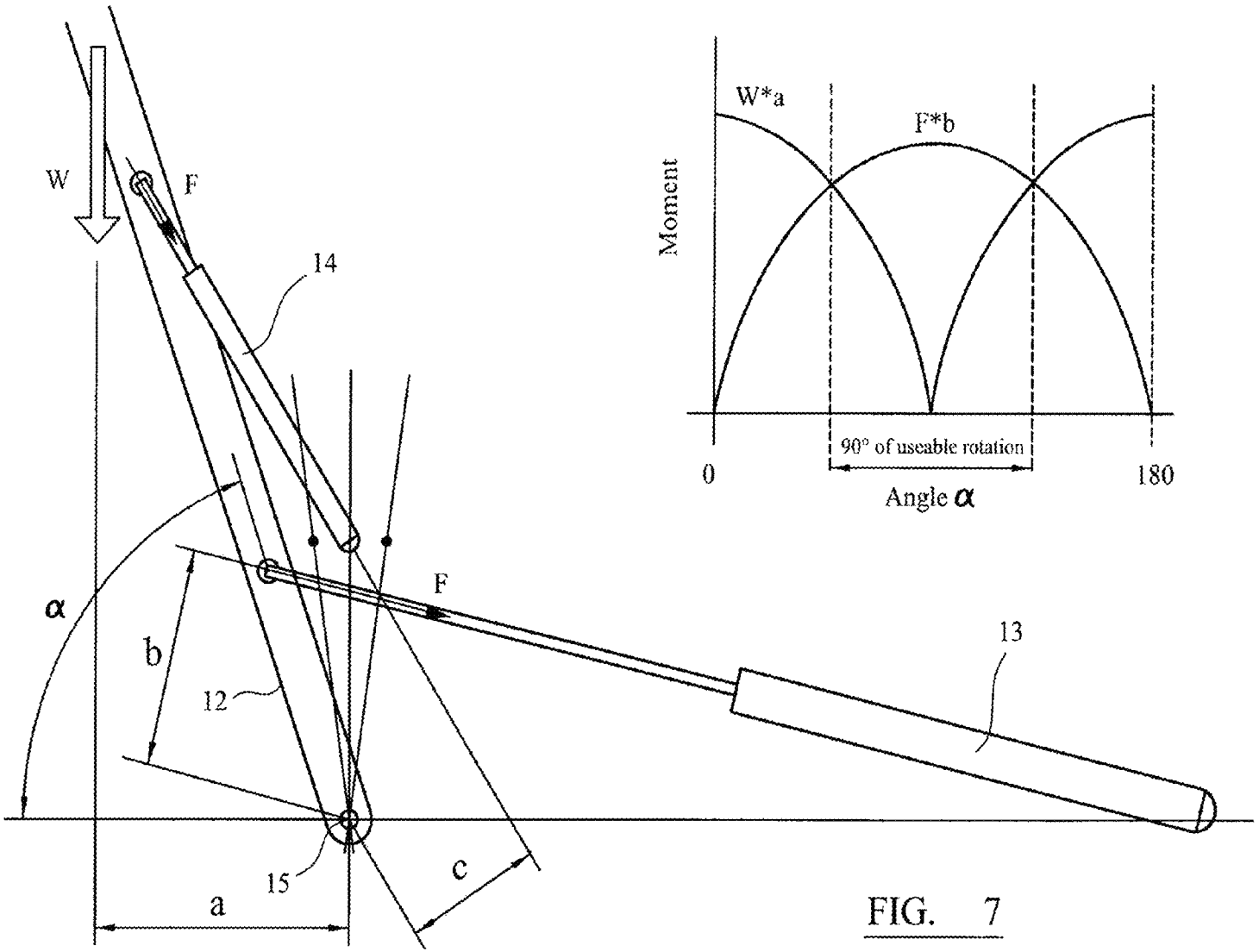
FIG. 7 is a diagram showing the 180° mechanism in comparison with the conventional 90° arrangement.

It will also be appreciated by persons skilled in the art that when the foot 18 is lifted from the ground (FIG. 11), the vehicle 2 must be sufficiently heavy to counterbalance the weight of the bridge 1 and the deployment apparatus 23. In the case of the present invention, the apparatus is able to rotate the bridge 1 through a sufficiently large angle to locate the centre of gravity of the bridge 1 within the wheelbase 41 of the vehicle 2 which allows for the use of lighter weight vehicles than is the case with some prior art. The prior art shown in FIG. 3 does achieve a similar position of the centre of gravity of the bridge 1 prior to lifting the foot, however this is at the expense of the complication of three stages as opposed to the two which is commonly found in other prior art.

Figure 15:
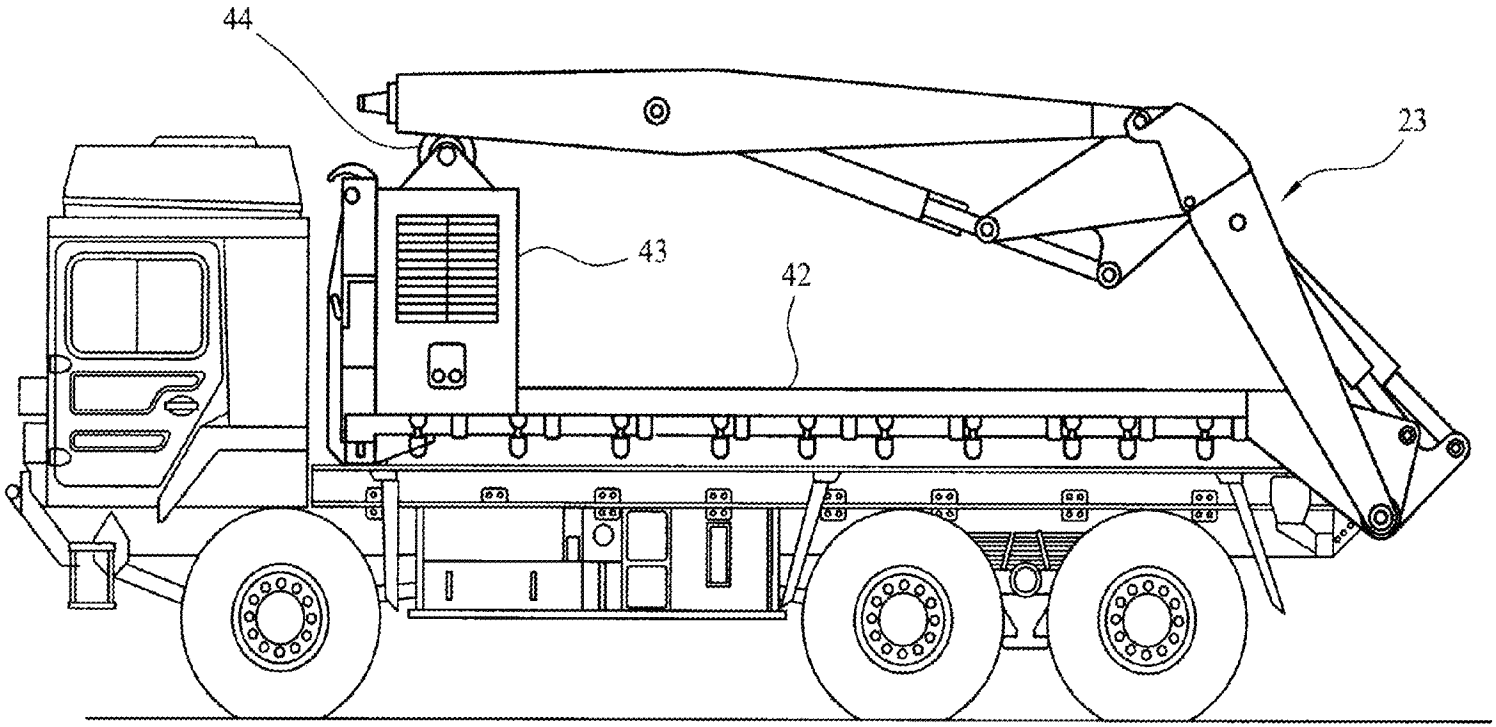
FIG. 15 shows exactly the same deployment apparatus as shown in FIGS. 8 to 14 but mounted on a cargo truck.

FIG. 15 shows the deployment apparatus 23 mounted on a pallet 42 with its own power supply 43. The deployment apparatus 23 is shown it a stowed position but is able to transport, deploy and recover a bridge in the same manner as shown in FIGS. 8 to 14. The pallet may be carried by a cargo truck equipped with a DROPS (Demountable Rack Offload and Pickup System) as shown or a normal flat bed truck.

Figure 16:
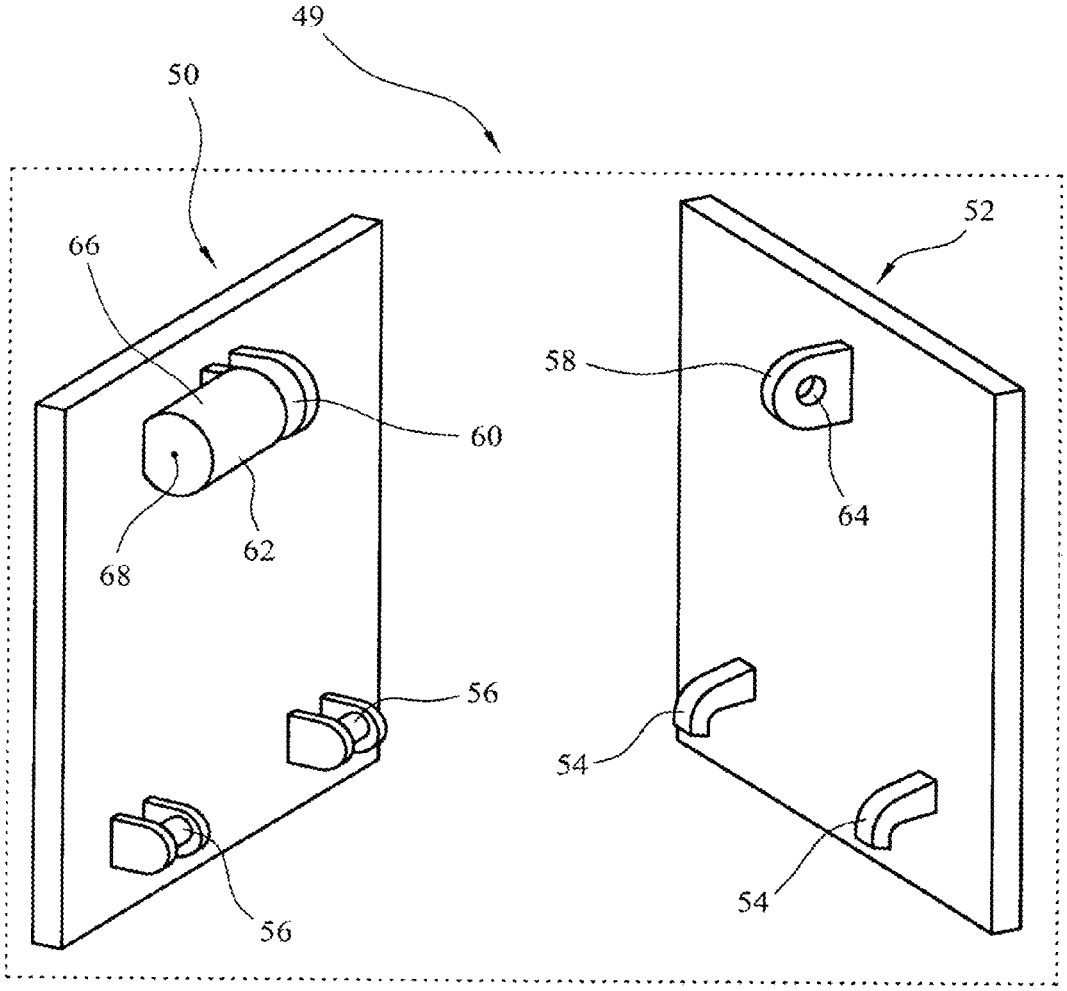
FIG. 16 shows one embodiment of a bracket for fitting a bridge deployment mechanism to a vehicle.

Referring to FIG. 16, the interface system 49 between the mounting bracket 19 and the vehicle 2 is shown. The interface system 49 comprises a first assembly 50 mounted to the vehicle 2, for example by welding, and a second assembly 52 attached to the mounting bracket 19. The second assembly 52 has a pair of hooks 54 which can engage in suitable corresponding brackets 56 on the first assembly 50. The second assembly 52 also incorporates a lug 58 which can engage in a corresponding suitable slot 60 in an actuator 62 on the first assembly 50. The lug 58 includes a hole 64, and the actuator 62 also has a hydraulic cylinder 66 which can insert and retract a pin 68 into/from the hole 64 in the lug 58 in the second assembly 52 to releasably retain the second assembly 52 on the first assembly 50.

With the hooks 54 engaged in the brackets 56 and the feature 58 engaged in the slot 60 of the actuator 62 and the hydraulic cylinder pin 68 engaged in the hole 64 in feature 58, the second assembly 52 is securely connected to the first assembly 50 and thus the bridge deploying apparatus 23 is securely connected to the vehicle 2.

To disconnect the first 50 and second 52 assemblies from each other, the bridge deploying apparatus 23 is ideally arranged to be lying gently on the ground, although the following is true even if in an emergency situation the bridge deploying apparatus 23 is at some height above the ground. Pin 68 is then retracted by the cylinder 66 from the hole 64 in the lug 58. The first assembly 50 remains attached to the vehicle 2, and the second assembly 52 attached to the bridge deploying apparatus 23 will now fall away from the vehicle 2, the exact motion of the second assembly 52 depending on the position/height of the bridge deploying apparatus 23 at the time the pin 68 is retracted. The vehicle 2 can now be reversed away from the bridge deploying apparatus 23 and second assembly 52 and in doing so the hooks 54 in the second assembly 52 will disengage from the bracket 56 in the first assembly 50.

It will be appreciated by persons skilled in the art that the above embodiment has been described by way of example only, and not in any limitative sense, and that various alterations and modifications are possible without departure from the scope of the invention as defined by the appended claims.

The invention claimed is:

1. An apparatus for carrying a bridge on a vehicle and deploying the bridge to the ground, the apparatus comprising:

at least one mounting device for mounting the apparatus to a vehicle;

at least one ground engaging member pivotable relative to the at least one said mounting device between a first position in which the at least one ground engaging member engages the ground for supporting the bridge and a second position in which the at least one ground engaging member is separated from the ground to permit movement of the vehicle;

at least one first actuator device for pivoting the at least one ground engaging member between said first and second positions;

at least one bridge engaging member pivotable relative to the at least one ground engaging member between a third position in which the bridge is on the ground and a fourth position in which the center of gravity of the bridge is raised relative to the third position; and at least one second actuator device for pivoting the at least one bridge engaging member between said third and fourth positions;

wherein at least one of said first actuator device and said second actuator device comprises at least two respective actuators arranged such that the sum of the turning moments produced by said at least two respective actuators is never zero when said at least one of said first actuator device and said second actuator device pivots between at least one of said first and second positions and said third and fourth positions.

2. An apparatus according to claim 1, further comprising a foot frame pivotable in use about an axis on the vehicle and transverse to a direction of travel of the vehicle and adapted to transfer the at least one ground engaging member between the ground and a location substantially at a height of a roof of the vehicle.

3. An apparatus according to claim 1, wherein the at least one bridge engaging member comprises a respective bridge engaging probe pivotably mounted on a transverse axis across the at least one ground engaging member and adapted to lay the bridge on the ground when the at least one ground engaging member is in the first position and above the vehicle when the at least one ground engaging member is in the second position.

4. An apparatus according to claim 1, wherein the at least one second actuator device is connected between the at least one bridge engaging member and the at least one ground engaging member and the at least one first actuator device is connected between the at least one ground engaging member and the vehicle.

5. An apparatus according to claim 1 wherein the at least two respective actuators are connected to separate locations on at least one of the mounting device and the ground engaging member, the separate locations being angularly offset relative to each other in planes transverse to a respective pivot axis of the at least one of the mounting device and the ground engaging member.

6. An apparatus according to claim 1, further comprising at least one roller adapted to be fixed on a roof of the vehicle for supporting the bridge when said roller is in contact with the bridge.

7. An apparatus according to claim 1 in which in the absence of the bridge, at least one of said at least one bridge engaging member and said at least one ground engaging member can be positioned in different positions from said respective fourth and second positions.

8. An apparatus according to claim 1, wherein at least one of said at least two respective actuators is a hydraulic cylinder.

9. An apparatus according to claim 8, further comprising at least one flow changing device for changing a direction of flow of hydraulic fluid into or out of said hydraulic cylinder at appropriate angular positions of a support frame connected to said hydraulic cylinder so that a direction of movement and continuity of rotation of the support frame proceeds in a desired direction.

10. An apparatus according to claim 8, further comprising at least one closing device for closing off ports to the hydraulic cylinder so as to selectively control the rotation of at least one of said ground engaging member and said bridge engaging member connected to said hydraulic cylinder, the closing device configured to selectively lock the rotation of a support frame connected to said hydraulic cylinder and to allow free flow of hydraulic fluid into or out of the hydraulic cylinder so that the support frame can rotate freely.

11. A vehicle comprising a vehicle body and an apparatus for carrying a bridge on a vehicle and deploying the bridge to the ground, the apparatus comprising:

at least one mounting device for mounting the apparatus to a vehicle;

at least one ground engaging member pivotable relative to the at least one mounting device between a first position in which the at least one ground engaging member engages the ground for supporting the bridge and a second position in which the at least one ground engaging member is separated from the ground to permit movement of the vehicle;

at least one first actuator device for pivoting the at least one ground engaging member between said first and second positions;

at least one bridge engaging member pivotable relative to the at least one ground engaging member between a third position in which the bridge is on the ground and a fourth position in which the center of gravity of the bridge is raised relative to the third position; and at least one second actuator device for pivoting the at least one bridge engaging member between said third and fourth positions;

wherein at least one of said first actuator device and said second actuator device comprises at least two respective actuators arranged such that the sum of the turning moments produced by said at least two respective actuators is never zero when said at least one of said first actuator device and said second actuator device pivots between at least one of said first and second positions and said third and fourth positions.

12. A vehicle according to claim 11, wherein the apparatus is adapted to be releasably mounted to the vehicle body.

13. A vehicle according to claim 12, wherein the apparatus is adapted to be releasably mounted to the vehicle body by means of a first assembly mounted on the apparatus that interlocks with a second assembly mounted on the vehicle body, and at least one of the first assembly and the second assembly can disengage from the other of the first assembly and the second assembly so that said first assembly and said second assembly are released.

* * * * *